United States Patent [19]

Archer

[11] 4,090,199

[45] May 16, 1978

[54] RADIO FREQUENCY BEAM FORMING NETWORK

[75] Inventor: Donald H. Archer, Santa Barbara, Calif.

[73] Assignee: Raytheon Company, Lexington, Mass.

[21] Appl. No.: 673,169

[22] Filed: Apr. 2, 1976

[51] Int. Cl.[2] ..... H01Q 3/26

[52] U.S. Cl. ..... 343/100 SA; 343/100 R; 343/854

[58] Field of Search ..... 343/100 R, 100 SA, 854

[56] References Cited

U.S. PATENT DOCUMENTS

| | | | |
|---|---|---|---|
| 3,380,052 | 4/1968 | Drabowitch et al. | 343/100 R X |
| 3,500,412 | 3/1970 | Trigon | 343/854 X |
| 3,731,316 | 5/1973 | Sheleg | 343/854 |
| 3,993,999 | 11/1976 | Hemmi et al. | 343/854 |

*Primary Examiner*—Maynard R. Wilbur
*Assistant Examiner*—Richard E. Berger
*Attorney, Agent, or Firm*—Richard M. Sharkansky; Joseph D. Pannone

[57] ABSTRACT

A radio frequency beam forming network is disclosed wherein a plurality of antenna feed elements arranged in the focal plane of a radio frequency lens is coupled to corresponding input ports of a radio frequency energy distributing means. Output ports of such radio frequency energy distributing means are coupled to a receiver/transmitter through different paths. Disposed in the different paths are active elements, including variable phase shifters and attenuators. The active elements, in response to control signals, provide proper attenuation and phase shift to the signals passing therethrough thereby to form a desired antenna beam. Such antenna beam is comprised of one or more "spot" beams. With such arrangements failure of a single one of the active elements will only slightly degrade system performance without resulting in a complete loss of any one of the "spot" beams.

13 Claims, 5 Drawing Figures

RADIO FREQUENCY BEAM FORMING NETWORK

BACKGROUND OF THE INVENTION

This invention relates generally to radio frequency antenna beam forming networks and more particularly to active beam forming networks adapted for use in connection with a multibeam antenna system to couple a selected one or ones of the antenna feed elements in the antenna system to receiver/transmitter apparatus thereby to form a desired composite antenna beam.

One application for such active beam forming network is in a satellite communication system. Here a geo-stationary satellite in a synchronous circular equatorial orbit above the earth carries a transponder to enable radio frequency communication between locations on the earth's surface. The transponder carried in the satellite in such application transmits and receives signals using a multibeam antenna system. The multibeam antenna system is coupled to a beam forming network which directs an antenna beam in accordance with command signals transmitted to the satellite from a station on the earth. In the particular satellite communication system herein described, the multibeam antenna system is configured so that each one of a plurality of "spot" beams covers a different, slightly overlapping area on the earth's surface viewed by the satellite. Each one of the "spot" beams is formed from an aperture having, substantially, the gain and bandwidth of the whole antenna. The beam forming network may be used on both transmit and receive to form selected one or ones of the plurality of "spot" beams. The antenna beam could vary anywhere from a single "spot" beam for spot coverage (i.e. as to cover the east coast of the United States for example) to a cluster of "spot" beams capable of covering the entire earth's surface as viewed by the satellite. Further, the beam forming network may be used to couple selected "spot" beams in particular amplitude and phase relationship in order to generate nulls in the antenna beam at angles corresponding to the locations of various jammers which may be present on the earth's surface.

One known beam forming network which is adapted for the application described above includes a metal plate lens and a planar array of $n$ antenna feed elements disposed in the focal plane of the metal plate lens, each one of such antenna feed elements being coupled to a receiver/transmitter through a "tree" network of variable power dividers. The "tree" network has at its apex a single variable power divider having an input coupled to the receiver/transmitter. Each one of a pair of output ports of such power divider is coupled to a corresponding one of two different variable power dividers which, in turn, are coupled to four different power dividers. The "tree" network continues until $n/2$ variable power dividers are coupled to the $n$ antenna feed elements. The power division ratio of each one of the variable power dividers in the "tree" network is individually set by control signals supplied thereto by the command signals from the station on the earth to synthesize the proper amplitude distribution over the array of antenna feed elements and thereby develop the desired composite antenna beam. Included in the path of each one of the antenna feed elements is a corresponding variable phase shifter which is also set by the command signals to provide a proper phase distribution and thereby develop the desired antenna beam. Preamplifiers are also disposed in the paths of the antenna feed elements to serve as a buffer against insertion losses associated with the beam forming network. While such beam forming network may generate the desired antenna beam, it is noted that failure of a single preamplifier, phase shifter or power divider may result in complete loss of coverage in the associated "spot" beam and, in fact, failure of a single critical variable power divider, specifically that which is connected to the receiver/transmitter at the apex of the "tree" network, results in the complete loss of half of the maximum possible antenna beam coverage. In the satellite application described above replacement of such preamplifier phase shifter or power divider is not practical for obvious reasons and hence the overall performance of the system must be designed to ensure high reliability over many years.

SUMMARY OF THE INVENTION

With this background of the invention in mind it is an object of this invention to provide an improved, highly reliable beam forming network.

This and other objects of the invention are attained generally by providing, in a radio frequency communication system, a plurality of antenna feed elements arranged in the focal plane of a radio frequency lens; means, having a plurality of input ports coupled to the plurality of antenna elements for distributing radio frequency energy fed thereto to a plurality of outputs thereof, such energy being distributed to such output ports with a phase distribution in accordance with the fed input port; a power combiner coupled between the output ports and a receiver/transmitter through different paths. Disposed in the different paths are active elements, including variable phase shifters and attenuators, responsive to command signals for providing phase shift and attenuation to radio frequency signals passing through such paths in accordance with such command signal. With such arrangement failure of a single one of such active elements only slightly degrades the performance of the communication system without any complete loss of coverage in any portion of the potential area coverage of such system.

BRIEF DESCRIPTION OF THE DRAWINGS

For a more complete understanding of the invention reference is now made to the following description and to the drawings in which.

DESCRIPTION OF THE PREFERRED EMBODIMENTS

Figure 1:
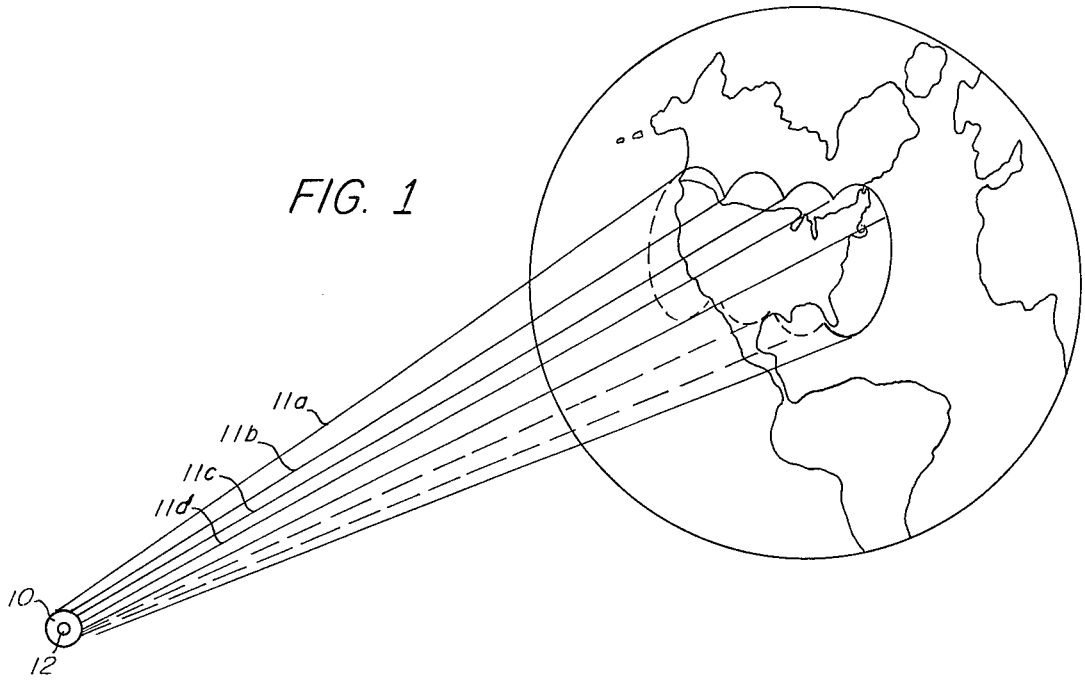
FIG. 1 is a general sketch of a satellite communication system according to this invention.

Referring now to FIG. 1, a satellite spacecraft 10 is shown in synchyronous, geo-stationary, circular equatorial orbit above the earth (not numbered). The satellite spacecraft 10 carries radio frequency communication transponder equipment 12, the details of which will be described in connection with FIG. 2. Suffice it to say here that the radio frequency communication transponder equipment 12 is adapted to enable radio frequency communication between desired locations on the earth as viewed by the satellite. The radio frequency communication transponder equipment 12 includes a multibeam antenna system, to be described, for synthesizing, in response to command signals from an earth station, a desired antenna beam which may vary from "spot" coverage so as to cover, for example, the east coast of the United States, to multiple "spot" coverage so as to cover, for example, the west coast of the United States and also eastern Europe, to complete coverage of the surface of the earth as viewed by the satellite spacecraft 10. As indicated here in FIG. 1, four "spot" beams, 11*a*–11*d*, are shown to cover continental United States.

Figure 2:
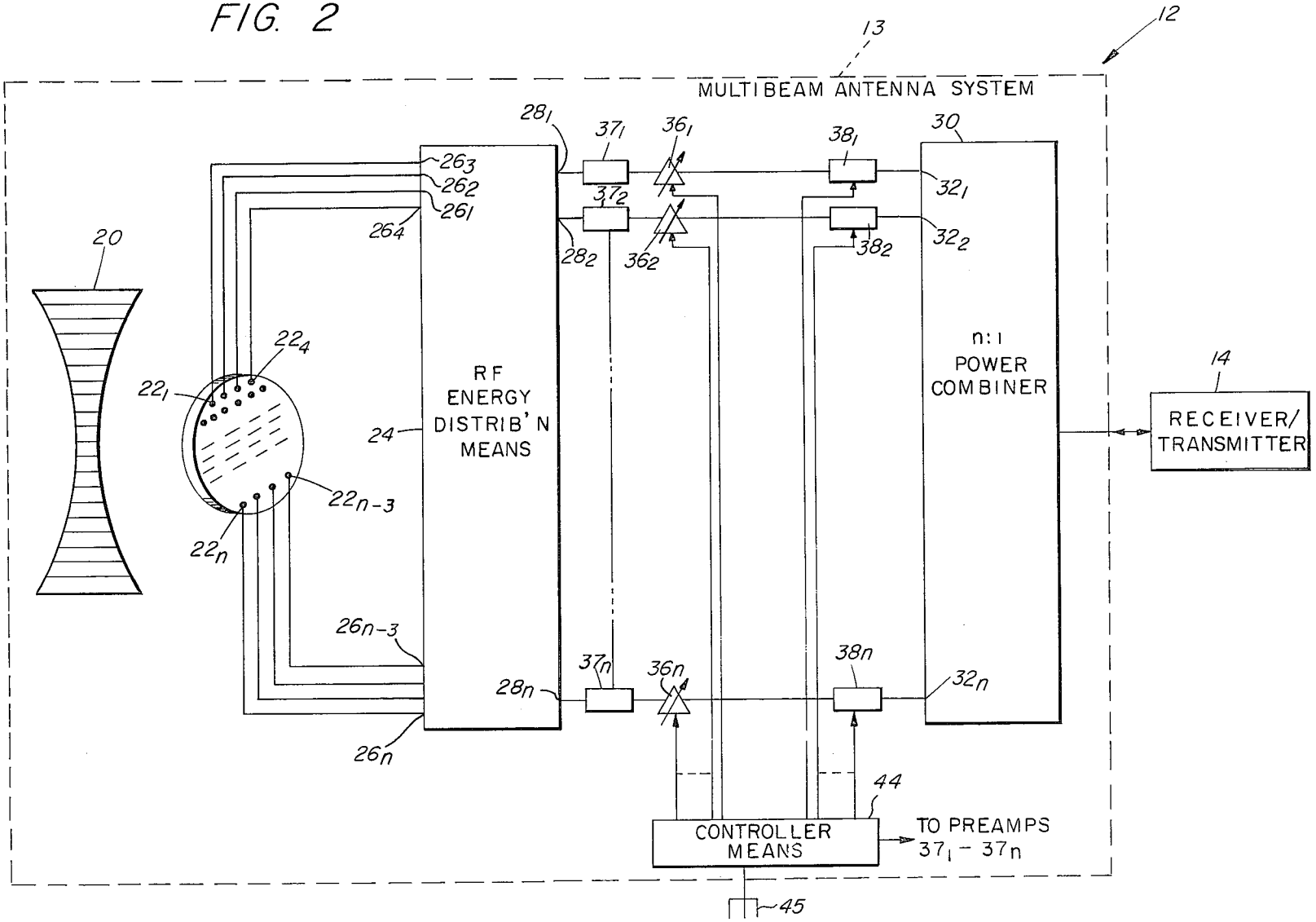
FIG. 2 is a block diagram of transponder equipment carried on the satellite shown in FIG. 1.

Referring now to FIG. 2, the radio frequency communication transponder equipment 12 is shown to include the multibeam antenna system 13 and coupled thereto a receiver/transmitter 14. Such receiver/transmitter 14 may be any wide band radio frequency receiver/transmitter such as for example similar to that described in U.S. Pat. No. 3,710,255, "Satellite Communication System", Francis A. Gicca, issued Jan. 9, 1973 and assigned to the same assignee as the present invention. The multibeam antenna system 13 includes a radio frequency lens, here a metal plate lens 20, a plurality of antenna feed elements $\mathbf{22}_1$–$\mathbf{22}_n$, here radio frequency horns, suitably mounted by any convenient means (not shown) in the focal plane of the metal plate lens 20, a radio frequency energy distributing means 24, here a Butler matrix, having $n$ inputs $\mathbf{26}_1$–$\mathbf{26}_n$ (each one thereof coupled to a corresponding one of the horns $\mathbf{22}_1$–$\mathbf{22}_n$) and $n$ outputs $\mathbf{28}_1$–$\mathbf{28}_n$. Also included is an $n$:1 power combiner 30, of any conventional design, here having $n$ input ports $\mathbf{32}_1$–$\mathbf{32}_n$ coupled to corresponding ones of the output ports $\mathbf{28}_1$–$\mathbf{28}_n$ through different paths. Disposed in corresponding ones of such different paths are variable phase shifters $\mathbf{36}_1$–$\mathbf{36}_n$, variable attenuators $\mathbf{38}_1$–$\mathbf{38}_n$ and preamplifier sections $\mathbf{37}_1$–$\mathbf{37}_n$ (to be described in detail in connection with FIG. 5) as shown. The power combiner 30 has a single output port 40 coupled to a receiver/transmitter 14 through a conventional transmit/receive switch (not shown). Also, a controller means 44 (the details of which will be described) is included, such controller means 44 being adapted to supply control signals to the variable phase shifters $\mathbf{36}_1$–$\mathbf{36}_n$ and variable attenuators $\mathbf{38}_1$–$\mathbf{38}_n$ (and preamplifiers $\mathbf{37}_1$–$\mathbf{37}_n$) in response to radio frequency command signals transmitted from the station on the earth and received by the satellite spacecraft 10 via radio frequency antenna 45.

Before describing the operation of the radio frequency communication transponder system 12, an initial programming procedure will be described, such procedure being performed prior to the launching of the satellite spacecraft 10 in order to program the controller means 44 and thereby enable such controller means 44 to provide, in response to the transmitted command signals, proper control signals for the variable phase shifters $\mathbf{36}_1$–$\mathbf{36}_n$ and variable attenuators $\mathbf{38}_1$–$\mathbf{38}_n$ thereby to generate a commanded, desired, antenna beam. In such programming procedure a radio frequency signal is fed into a first one of the $n$ antenna feed elements $\mathbf{22}_1$–$\mathbf{22}_n$. Such radio frequency signal is divided into $n$ signals by the energy distributing means 24, such divided signals appearing at output ports $\mathbf{28}_1$–$\mathbf{28}_n$. The signals at such output ports $\mathbf{28}_1$–$\mathbf{28}_n$ will have a substantially linear phase relationship from output port to output port. The slope of the linear phase relationship is related to the particular one of the antenna feed elements $\mathbf{22}_1$–$\mathbf{22}_n$ which is excited. Therefore, as succeeding ones of the antenna feed elements $\mathbf{22}_1$–$\mathbf{22}_n$ are so energized the slopes of the linear phase relationships will have correspondingly different slopes. Now, with any particular one of the antenna feed elements $\mathbf{22}_1$–$\mathbf{22}_n$ excited, the variable phase shifters $\mathbf{36}_1$–$\mathbf{36}_n$ and variable attenuators $\mathbf{38}_1$–$\mathbf{38}_n$ are controlled so that maximum power is transferred from the excited one of the antenna feed elements $\mathbf{22}_1$–$\mathbf{22}_n$ to the receiver/transmitter 14. The Table below is thereby generated to provide an indication of the relationship between the excited one of the antenna feed elements $\mathbf{22}_1$–$\mathbf{22}_n$ and an associated control word which, when such associated control word is supplied to the variable phase shifters $\mathbf{36}_1$–$\mathbf{36}_n$ and variable attenuators $\mathbf{38}_1$–$\mathbf{38}_n$, enable maximum power to be transferred from the excited one of the antenna feed elements $\mathbf{22}_1$–$\mathbf{22}_n$ to the receiver/transmitter 14. The control words are then stored in a memory 50 (FIG. 4) included in the controller means 44. A selected one or ones of control words are read from such memory in response to the command signals in a manner to be described. It follows then that, in operation, when the controller means 44 supplies signals to the variable phase shifters $\mathbf{36}_1$–$\mathbf{36}_n$ and variable attenuators $\mathbf{38}_1$–$\mathbf{38}_n$, which signals represent one of the stored control words, a "spot" antenna beam associated with such control word is formed by the multibeam antenna system 13. For example, on transmission (realizing that principles of reciprocity apply during reception) radar frequency energy transmitted by receiver/transmitter 14 will pass through power combiner 30 to the ports $\mathbf{28}_1$–$\mathbf{28}_n$ of the energy distributing means 24, the gain and phase of such signals being adjusted by the variable phase shifters $\mathbf{36}_1$–$\mathbf{36}_n$ and variable attenuators $\mathbf{38}_1$–$\mathbf{38}_n$ in accordance with the control word supplied thereto by the controller means 44. The signals applied to the energy distributing means 24 are then directed to the one of the antenna feed elements $\mathbf{22}_1$–$\mathbf{22}_n$ associated with such supplied control word. The energy radiates from such selected one of the antenna feed elements $\mathbf{22}_1$–$\mathbf{22}_n$ and is focused by the metal plate lens 20 in the proper direction to provide a "spot" beam at the location on the earth's surface selected by the command signal.

Table

| Antenna Feed Element | Variable Phase Shifter | Variable Attenuator | Control Word |
|---|---|---|---|
| $22_1$ | $36_1$ | $38_1$ | $R_{1,1}e^{j\theta}1,1$ |
| | ⋮ | ⋮ | ⋮ |
| | $36_n$ | $38_n$ | $R_{1,n}e^{j\theta}1,n$ |
| $22_2$ | $36_1$ | $38_1$ | $R_{2,1}e^{j\theta}2,1$ |
| | ⋮ | ⋮ | ⋮ |
| | $36_n$ | $38_n$ | $R_{2,n}e^{j\theta}2,n$ |
| ⋮ | ⋮ | ⋮ | ⋮ |
| $22_n$ | $36_1$ | $38_1$ | $R_{n,1}e^{j\theta}n,1$ |
| | ⋮ | ⋮ | ⋮ |
| | $36_n$ | $38_n$ | $R_{n,n}e^{j\theta}n,n$ |

It is noted that the control word is presented above in polar notation, the magnitude portion, $R_{a,b}$ representing the setting of the variable attenuator and the angle portion $\theta_{a,b}$ representing the variable phase shifter setting.

Figure 4:
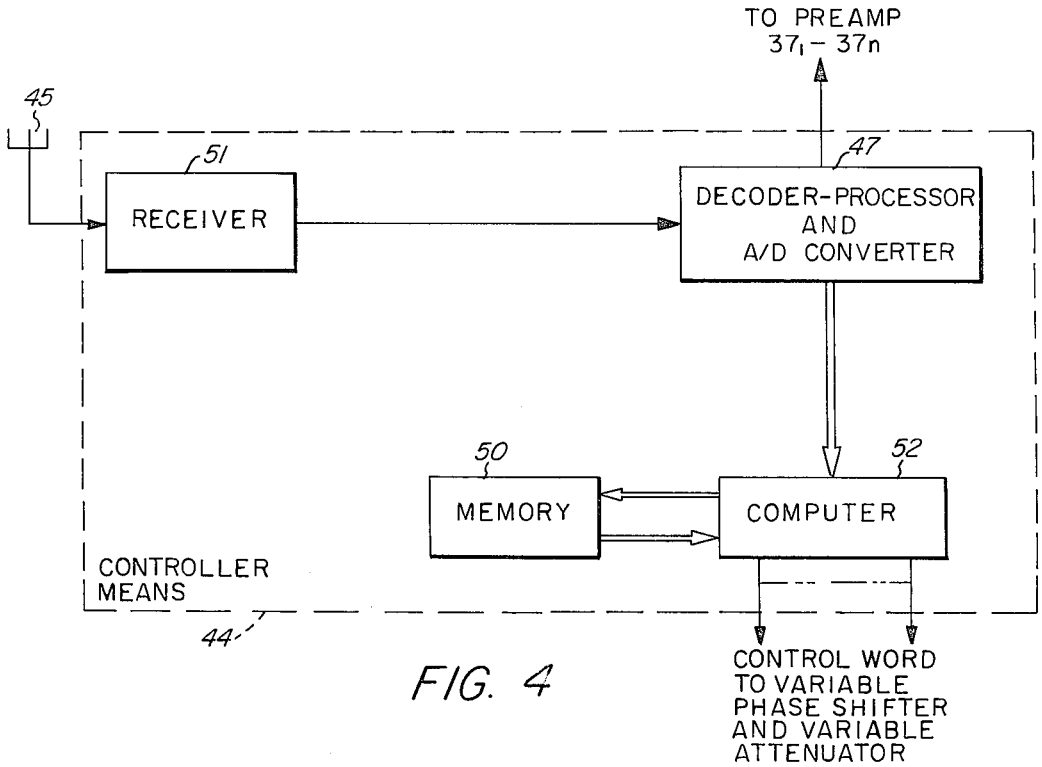
FIG. 4 is a simplified block diagram of a controller means used in the transponder equipment shown in FIG. 2.

The control words described above are stored as digital words in the conventional memory 50 included in controller means 44 (FIG. 4). One portion (one set of bits) of each one of the stored digital words (i.e. the phase portion "$\theta$") is for use in developing control signals for the variable phase shifters $36_1$–$36_n$ and the other portion (i.e. the magnitude portion "R") of each one of such stored digital words is for use in developing signals for the variable attenuators $38_1$–$38_n$. The locations of the stored digital words correspond to the antenna feed elements $22_1$–$22_n$. Hence, for example, location 1 of the memory stores the digital word equivalent of the control words associated with antenna feed element $22_1$, as shown in the Table.

It follows then that any one of the *n* beams may be individually generated during either transmit or receive by controller means 44 supplying, in response to the command signal from the location on the earth, the control words associated with such one of the beams to the variable phase shifters $36_1$–$36_n$ and variable attenuators $38_1$–$38_n$.

For a composite beam, that is where two or more of the antenna feed elements $22_1$–$22_n$ are to be excited during, say transmit, (realizing that principles of reciprocity apply when considering reception of receiver signals) the control words associated with each one of the beams are vectorially added in the controller means 44 by any conventional microprocessor or computer 52 (FIG. 4) in the following manner: For example, if it is desired to form an antenna beam made up of "spot" beams *a, b* and *c,* a radio frequency signal representing this command signal is transmitted from a station on the earth to the satellite spacecraft 10. Such signal is fed to receiver 51 (FIG. 4) via antenna 45. The received signal is detected, decoded and converted into a digital word by conventional processing equipment 47 and then passed to computer 52, all in a conventional manner. The digital word causes the computer 52 to vectorially add the control words associated with each one of the "spot" beams *a, b* and *c.* The control signals supplied by the controller means 44 to the variable attenuators $38_1$–$38_n$ and variable phase shifters $36_1$–$36_n$ are calculated by the computer 52 as follows:

Table

| Antenna Feed Elements | Variable Phase Shifter | Variable Attenuator | Control Word |
|---|---|---|---|
| $22_a, 22_b, 22_c$ | $36_1$ | $38_1$ | $R_{a\text{-}c,1}e^{j\theta}a\text{-}c,1$ |
| | . | . | . |
| | . | . | . |
| | . | . | . |
| | $36_n$ | $38_n$ | $R_{a\text{-}c,n}e^{j\theta}a\text{-}c,n$ |

where $R_{a\text{-}c,1}e^{j\theta}a\text{-}c,1 = R_{a,1}e^{j\theta}a,1 + R_{b,1}e^{j\theta}b,1 + R_{c,1}e^{j\theta}c,1$

.

.

.

$R_{a\text{-}c,n}e^{j\theta}a\text{-}c,n = R_{a,n}e^{j\theta}a,n + R_{b,n}e^{j\theta}b,n + R_{c,n}e^{j\theta}c,n$ The magnitude portions (i.e. $R_{a\text{-}c,1} \ldots R_{a\text{-}c,n}$) are fed to the variable attenuators $38_1$–$38_n$ and the phase portions (i.e. $\theta_{a\text{-}c,1} \ldots \theta_{a\text{-}c,n}$) are fed to the variable phase shifters $36_1$–$36_n$.

It is here noted that, at the expense of some degradation in the synthesized beam, it is possible to perform such synthesis solely with phase control thereby eliminating the bank of variable attenuators $38_1$–$38_n$. The principle degradation will appear as increased sidelobe levels in the synthesized beam. The programming procedure is equivalent to that described above except that only the phase portion of the control word is retained while the magnitude portion of such word is set equal to unity.

Figures 3, 5:
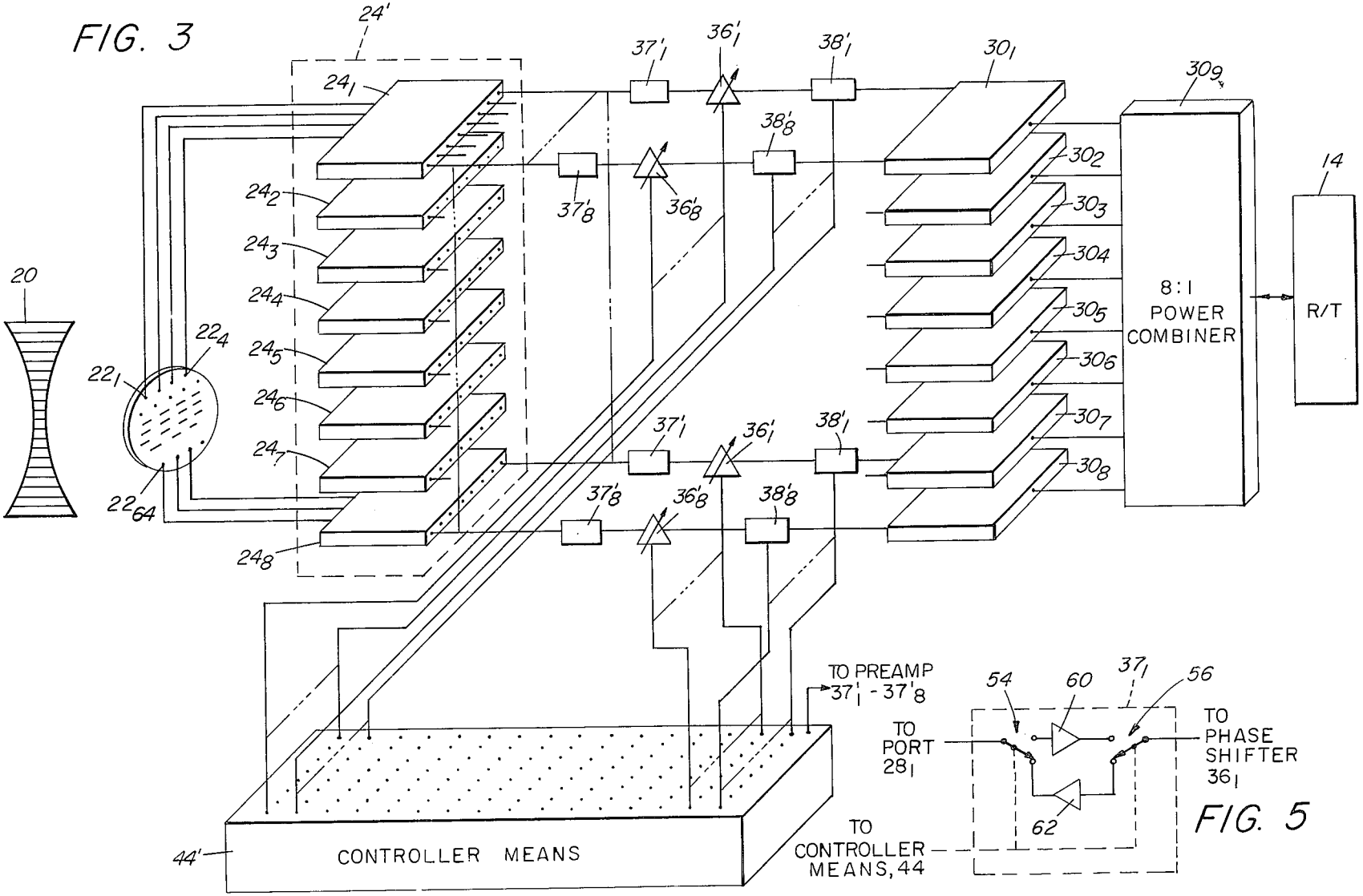
FIG. 3 is a block diagram of an alternate embodiment of the transponder equipment according to the invention.
FIG. 5 shows an exemplary one of the preamplifier sections included in the transponder equipment.

Referring now to FIG. 3, an alternate embodiment of the energy distributing means 24 is shown. Here energy distributing means 24' is particularly useful where the number of antenna feed elements $22_1$–$22_n$ is so large that a single Butler matrix is impractical because of excessive size and complexity. Here the plurality of antenna feed elements $22_1$–$22_n$ is divided into sets, the antenna feed elements $22_1$–$22_n$ in each one of such sets being coupled to a different one of the plurality of Butler matrices. For example, with sixty-four antenna feed elements $22_1$–$22_{64}$ divided into eight sets, eight Butler matrices $24_1$–$24_8$ are used as shown in FIG. 3. The eight antenna feed elements in each set are coupled to one of the eight matrices. Each set is coupled to a corresponding one of the matrices. Each one of the Butler matrices $24_1$–$24_8$ is fed to a corresponding one of eight power combiners $30_1$–$30_8$. Variable phase shifters $36_1'$–$36_8'$, attenuators $38_1'$–$38_8'$ and preamplifier sections $37_1'$–$37_8'$ are disposed in the lines between each one of the Butler matrices $24_1$–$24_8$ and a corresponding one of the power combiners $30_1$–$30_8$ as shown. That is, here eight sets of eight preamplifiers, eight variable phase shifters and eight variable attenuators are used. The output of the power combiners $30_1$–$30_8$ is fed to an 8:1 power combiner 30, the output of which is fed to the receiver/transmitter 14 as described in FIG. 2. An equivalent programming procedure to that described in connection with FIG. 2 is used to develop the control words which are stored in a memory (not shown) included in the controller means 44'. Composite beams are formed by vectorially adding the control words associated with the individual "spot" beams making up the composite beams as described above in connection with FIG. 2. It is here noted that the magnitude portion of each control word is sent to 64 variable attenuators and the phase portion of such control word is sent to 64 variable phase shifters. Further, the 64 attenuators and 64 phase shifters are independently controlled in order to produce the desired antenna beam.

Referring now to FIG. 5, an exemplary one of the preamplifier sections, here preamplifier section 37, is shown to include a "receive" preamplifier 60, a "transmit" preamplifier 62 and a pair of switches 54, 56 arranged and shown, and responsive to transmit/receive control signals supplied by controller 44 to, on transmit, couple transmit preamplifier 62 between port $28_1$ and variable phase shifter $36_1$ and, on receive, couple receive preamplifier 60 between port $28_1$ and phase shifter $36_1$.

Having described preferred embodiments of the invention it will now be immediately evident to a person of skill in the art that the concept of this invention may be implemented in different ways than those illustrated and explained hereinbefore. For example, the phase shift and attenuator command signals may be modified in order to provide a desired amplitude and phase distribution to the antenna feed elements to further shape the antenna beam. Such modification in the amplitude and phase distribution may be used, for example, if it is desired to "null out" a particular region on the earth, as if a jamming source is located in such region. In any event, during "transmit" or "receive" radio frequency energy passes between the antenna feed elements and the receiver/transmitter through all of the active elements (i.e. preamplifier sections, phase shifters and attenuators) and therefore failure of one of such elements will not result in a complete loss of any one of the "spot" beams. It is felt, therefore, that this invention should not be restricted to the disclosed embodiments but rather should be limited only by the spirit and scope of the appended claims.

What is claimed is:

1. A beam forming network adapted to form a plurality of beams, each one being directed along a different direction, comprising:

(a) a radio frequency lens;

(b) a plurality of radio frequency antenna feed elements disposed in the focal plane of the radio frequency lens, each one of the feed elements being associated with a corresponding one of the plurality of beams;

(c) means, having a plurality of input ports coupled to the plurality of antenna feed elements, for distributing radio frequency energy fed thereto to output ports thereof, the energy fed to any one of such input ports being distributed to the plurality of output ports with a phase distribution across such output ports being related to the one of the input ports being fed;

(d) combiner means having a plurality of input ports coupled to the output ports of the distributing means through different paths, and an output port; and (e) means, including a plurality of active elements disposed in such different paths for providing predetermined phase shifts to the radio frequency signals passing through the different paths to maximize power transfer between ones of the plurality of feed elements and the output port selectively in accordance with control signals enabling formation of beams along directions corresponding to the beams associated with such selected ones of the feed elements.

2. The beam forming network recited in claim 1 wherein the energy distributing means includes a Butler matrix feed.

3. The beam forming network recited in claim 1 wherein the active elements include a plurality of variable phase shifters.

4. In a radio frequency communication system wherein a beam forming network is adapted to form a plurality of independent beams, each one being associated with a corresponding one of a plurality of antenna feed elements, selected ones of such beams being formed in response to control signals supplied to such beam forming network, the improvement comprising:

(a) a radio frequency lens having a focal plane, the antenna elements being disposed in such focal plane;

(b) means, coupled to the plurality of antenna feed elements, for distributing radio frequency energy applied to any one of the antenna feed elements to a plurality of outputs of such means; and (c) means, coupled to the distributing means through a plurality of different paths, including a plurality of active elements disposed in said different paths, for maximizing the power transfer between selected ones of the plurality of antenna feed elements and the receiver/transmitter in response to said control signals, the selected ones of the plurality of feed elements forming corresponding beams along different directions.

5. The improvement recited in claim 4 wherein the distributing means includes a plurality of input ports and a plurality of output ports and means for distributing energy fed to any one of the input ports to the plurality of output ports with a phase distribution across such output ports related to the one of the input ports being fed.

6. The improvement recited in claim 5 wherein the active elements include a plurality of variable phase shifters.

7. The improvement recited in claim 6 wherein the active elements include a plurality of variable attenuators.

8. The improvement recited in claim 7 wherein the distributing means includes a Butler matrix feed.

9. A beam forming network, comprising:

(a) a radio frequency lens having a focal plane;

(b) a plurality of antenna feed elements disposed in the focal plane, each one of the feed elements being associated with a corresponding one of a plurality of beams, each beam having a different direction;

(c) means, having a plurality of input ports coupled to the plurality of antenna feed elements, and a plurality of output ports, for distributing radio frequency energy fed to any one of such input ports to the plurality of output ports;

(d) a power combiner having an output port and a plurality of input ports, such input ports being coupled to the plurality of output ports of the distributing means through different paths;

(e) a plurality of variable phase shifters disposed in the different paths; and (f) a control signal source coupled to the plurality of phase shifters for enabling such phase shifters to provide predetermined phase shifts to the radio frequency signals passing therethrough to maximize the power transfer from selected ones of the feed elements to the output port of the power combiner to form different beams along correspondingly different directions.

10. The beam forming network recited in claim 9 including a plurality of variable attenuators disposed in the different paths and responsive to the control signal source for enabling such attenuators to provide a predetermined attenuation to the radio frequency signals passing therethrough.

11. The beam forming network recited in claim 10 wherein the distributing means includes means for distributing the radio frequency energy fed to any one of such input ports to the plurality of output ports with a phase distribution across such output ports related to the one of the input ports being fed.

12. The beam forming network recited in claim 11 wherein the distributing means includes a Butler matrix feed.

13. A beam forming network comprising:

(a) a radio frequency lens;

(b) N radio frequency feed elements disposed in the focal plane of the radio frequency lens, each one of the feed elements being associated with a corresponding one of a plurality of beams;

(c) M Butler matrices, each one having N/M input ports and N/M output ports, the input ports of the M Butler matrice being coupled to the N radio frequency feed elements, where N is greater than M;

(d) M power combiners, each one having an output port and N/M input ports, such input ports being coupled to the output ports of a corresponding one of the Butler matrices through different paths;

(e) an output power combiner having M input terminals coupled to the output ports of the M power combiners and an output terminal;

(f) a plurality of variable phase shifters disposed in the different paths; and, (g) a control signal source coupled to the plurality of phase shifters for enabling such phase shifters to provide predetermined phase shifts to the radio frequency signals passing therethrough to maximize the power transfer from selected ones of the feed elements to the output terminal of the output power combiner.

* * * * *